US007152754B2

(12) United States Patent
Micciulla

(10) Patent No.: US 7,152,754 B2
(45) Date of Patent: Dec. 26, 2006

(54) TAB PLATE

(76) Inventor: Richard M Micciulla, 48 Old Brook Cir., Melrose, MA (US) 02176

( * ) Notice: Subject to any disclaimer, the term of this patent is extended or adjusted under 35 U.S.C. 154(b) by 458 days.

(21) Appl. No.: 10/724,247

(22) Filed: Nov. 28, 2003

(65) Prior Publication Data

US 2005/0115974 A1 Jun. 2, 2005

(51) Int. Cl.
*B65D 1/34* (2006.01)

(52) U.S. Cl. ..... 220/574

(58) Field of Classification Search ..... None
See application file for complete search history.

(56) References Cited

U.S. PATENT DOCUMENTS

| | | | | |
|---|---|---|---|---|
| 704,139 | A | 7/1902 | Stadelman | |
| 2,436,566 | A * | 2/1948 | Goldberg | 220/203.05 |
| 2,647,678 | A | 8/1953 | Olson | |
| 2,669,379 | A | 2/1954 | Olson | |
| 2,940,634 | A | 6/1960 | Wild | |
| 3,355,082 | A | 11/1967 | Wood | |
| 3,422,986 | A | 1/1969 | Tilseth | |
| 3,446,416 | A | 5/1969 | Epstein | |
| 4,609,140 | A | 9/1986 | Van Handel et al. | |
| 4,721,499 | A | 1/1988 | Marx et al. | |
| 4,721,500 | A | 1/1988 | Van Handel et al. | |
| 4,744,597 | A | 5/1988 | Bauman et al. | |
| 4,746,057 | A | 5/1988 | Wagner | |
| 4,966,297 | A | 10/1990 | Doty | |
| 5,056,424 | A * | 10/1991 | Lai | 99/339 |
| 5,088,640 | A | 2/1992 | Littlejohn | |
| 5,184,750 | A | 2/1993 | Moller | |
| 5,323,910 | A | 6/1994 | van de Graaf, Jr. | |
| 5,326,020 | A | 7/1994 | Cheshire et al. | |
| 5,346,070 | A | 9/1994 | McSpadden | |
| 5,381,905 | A | 1/1995 | Mallmamm et al. | |
| 5,607,077 | A | 3/1997 | Torkelson | |
| 5,662,240 | A | 9/1997 | Norris | |
| 5,669,505 | A | 9/1997 | Mayer | |
| 5,890,549 | A | 4/1999 | Sprehe | |
| 6,129,235 | A | 10/2000 | Creske | |
| 6,299,918 | B1 | 10/2001 | Morgese | |
| 6,415,944 | B1 | 7/2002 | Toussant | |
| D468,589 | S | 1/2003 | Bulcher et al. | |

FOREIGN PATENT DOCUMENTS

| | | |
|---|---|---|
| DE | 811 944 | 8/1951 |
| DE | 201 14 007 U1 | 2/2003 |
| WO | WO-97/00040 | 1/1997 |

OTHER PUBLICATIONS

Webpage for Dixie brand shaped disposable plates http://www.gp.com/krazykritters/ (print attached).

* cited by examiner

*Primary Examiner*—Stephen Castellano
(74) *Attorney, Agent, or Firm*—Scott Lefton

(57) ABSTRACT

There is disclosed a disposable tab plate adapted to allow the user to grip the plate and the plate's food contents without directly touching the food. This tab plate comprises a generally planar surface bounded by a perimeter for retaining food, and extending generally parallel to the planar surface from an edge of the perimeter an articulated tab, formed as one piece with the body of the plate. The tab plate may be manufactured from any flexible material that conventional disposable plates are composed of. In use, the tab is either left flat to serve as a rigid stabilizing handle, or is bent along a series of pre-formed fold lines, and folded up and over the plate and contents, thus enabling the user to place their fingers under the plate body, and their thumb upon the tab to grip the plate and contents without direct contact and with increased control.

22 Claims, 6 Drawing Sheets

TAB PLATE

CROSS REFERENCE TO RELATED APPLICATIONS

N/A

STATEMENT REGARDING FEDERALLY SPONSORED RESEARCH OR DEVELOPMENT

N/A

BACKGROUND

The present invention relates generally to food plates, and more specifically to a disposable plate with a tab feature that provides the options of being grasped in a flat state for improved stabilizing of the filled plate and of being articulated to grasp the food on the plate without the user directly touching the food.

A conventional disposable food plate meant for an individual to eat from is typically composed of a generally flat surface bordered by a raised rim. This surface can be slightly dished, and while generally round in shape, can additionally be oval, square, hexagonal, octagonal, or of any other shape or combination of shapes. Typically, disposable plates are between 6" and 12" in diameter. The rim serves the function of acting as a perimeter means for retaining the food on the plate, thus keeping the food from sliding off the edges of the plate if the plate is slightly tilted or if the plate or the food contents are acted upon by external forces. The rim is also the primary feature to grasp on the conventional plate. Additionally, the rim serves as a wall against which pieces of food may be captured with utensils such as a fork or a spoon.

Conventional disposable food plates are generally manufactured from thin, flexible materials such as of paper, coated paper, thermoformed plastic sheet, molded plastic or plastic foam, cardboard, corrugated cardboard and combinations of any of these. Both the materials and the manufacturing techniques are well known to those of ordinary skill in the art, and are also relatively inexpensive. The rim on the disposable plate is designed to stiffen the entire plate so as to preclude the plate bending in an uncontrolled manner when the plate is loaded with food. U.S. Pat. No. 5,326,020 filed Aug. 31, 1993 entitled RIGID PAPERBOARD CONTAINER, and U.S. Pat. No. 5,088,640 filed Sep. 6, 1991 entitled RIGID FOUR RADII RIM PAPER PLATE show typical examples of accomplishing rim forming and stiffening with paper or coated paper materials. These rim forming and stiffening manufacturing processes do not apply to the other above-listed materials, which are also inherently stiffer materials than the paper or coated paper. Even so, all conventional disposable plates are somewhat flexible, and this can cause handling problems.

A frequent problem associated with conventional disposable plates is unsanitary and messy handling of food. Because of the flexibility of disposable plates, the user may need to stabilize a filled plate by grasping the plate both from below and from above, with some number of fingers directly contacting the food. As disposable plates are often used in the fast food and food vending businesses, the health and safety of the customer frequently depends on the hygiene of the server especially when the food is directly handled by the server. Further, the recipient of the food-filled paper plate may not want to have their own fingers make direct contact with the food, either for reasons of sanitation or for reasons of personal neatness. At some food establishments the vendors wear gloves to prevent sanitary risks or the appearance of such, and may even hand out napkins for grasping the food. The customer has no way of knowing what the vendor has touched with the gloves, and is faced with disposal of a soiled napkin before consuming the food.

Frequently, disposable plates are used at parties, buffets, picnics or other situations where people will stand and move around while holding a plate of food. The standard use of a knife and fork to cut up food is made more difficult under these circumstances. In many cases, the food would be easy to cut up with the edge of a fork if the food could be held while cutting, but the other hand is committed to holding the plate, and just stabilizing the plate and the food is enough of a challenge. All of the problems mentioned so far are magnified if the food is too hot to safely or comfortably touch.

There are several known previously attempted solutions to the problem of food handling by adapting a container to allow the user to grasp a food item without directly touching it. Each of these previous inventions has certain disadvantages. These previous inventions all have a specialized shape that prevents function as a conventional and general-purpose food plate. For example, U.S. Pat. No. 6,299,918 filed Dec. 27, 1999 entitled PIZZA SERVER and U.S. Pat. No. 5,381,905 filed May 4, 1993 entitled DISPOSABLE SUPPORT FOR PIZZA both address the problem of serving and manipulating an individual slice or single serving of pizza without directly touching the pizza slice or single serving, but both inventions are specific to the pizza slice or single serving shape and type of food. U.S. Pat. No. 4,890,549 filed Aug. 24, 1988 entitled FOOD HOLDING DEVICE is a molded plastic tool for grasping and supporting a slice of pizza, and has neither a continuous bottom surface nor any raised rim, and thus is unable to function as even as much of a food plate as the previously cited patents.

U.S. Pat. No. 5,669,505 filed Apr. 8, 1996 entitled DISPOSABLE SERVING TRAY additionally requires folding and assembly either by the end user or by the vendor using the tray, and the tray is specific in shape to holding and serving an ear of corn.

German Patent No. 811,994 filed Jul. 8, 1949 (No English Title) has a grasping structure but lacks a continuous raised rim for retaining any food contents, and is only able to hold a single sausage-like food item.

German Patent No. DE20114007U1 filed Aug. 24, 2001 (No English Title) shows a food supporting and grasping invention with some more general functionality than the inventions described above, but this invention has a complete lack of any raised rim, continuous or interrupted, for retaining the food. This invention was designed to function as a serving device for flat foods like pizza, and has little more capability than that.

The challenge of stabilizing a food-filled disposable plate has been addressed by many inventors. U.S. Pat. No. 5,662,240 filed Feb. 13, 1996 entitled DISPOSABLE PLATE WITH FLEXIBLE HANDLES shows a plate stabilizing solution that requires the user to insert fingers into formed loops in order to work. Some may find this finger insertion uncomfortable or inconvenient, and the loop structure also represents extra manufacturing steps. U.S. Pat. No. 4,746,057 filed Mar. 25, 1986 entitled FINGER-STABILIZED EATING PLATE shows a finger-stabilized eating plate. This invention also requires extra components to be attached to the plate, thus increasing unit cost. The same problem with extra components is present in U.S. Pat. No. 2,647,678 filed May 5, 1950 entitled HOLDER FOR PAPER PLATES AND THE LIKE which additionally requires the user to be sitting for the invention to provide any benefit. U.S. Pat. No. 2,669,379 filed Aug. 3, 1950 entitled PLATE PROVIDED WITH DEPENDING GRIPPING MEANS is formed from one piece, but the method of stabilizing still requires the user to be sitting. U.S. Pat. No. 4,966,297 filed Feb. 14, 1990 entitled FOOD AND BEVERAGE SNACK TRAY shows an invention that is a tray rather than a plate, but the tray can be held while standing, and has more of a tab structure for hand stabilizing the tray. However, this snack tray suffers from the problem of an interrupted perimeter, and has no features that will aid in gripping the food. Additionally, forming this out of the sort of paper stock often used for disposable food plates would be difficult. U.S. Pat. No. 6,129,235 filed Dec. 14, 1998 entitled PARTY TRAY is representative of a large group of specialized plate inventions, having multiple specialized compartments and a holding and stabilizing feature. However, the sheer number of compartments renders this type of specialized plate far less usable for more general food applications.

Another problem with plates of both the conventional reusable as well as the disposable variety is that there is generally not a vertical enough rim to assist in gathering food efficiently onto a fork or spoon. U.S. Pat. No. 3,422,986 filed Mar. 20, 1967 entitled DISH LIP PLATE ATTACHMENT is typical of a group of inventions intended to solve this food gathering problem. This invention attaches to the plate to provide a higher and more vertical rim. However, inventions of this type are separate elements, and are not suitable for use with disposable plates.

A further problem with disposable plates is their lightweight nature, and susceptibility to even minor amounts of wind when used outdoors and empty or lightly filled. There is a need for a way to weigh down the empty plate with commonly associated and relatively heavy objects such as metal utensils, beverage cups, bottles or cans, without compromising the food-containing capability of the plate.

Securing napkins against wind is another problem associated with outdoor eating, using either conventional reusable or disposable plates. U.S. Pat. No. 5,607,077 filed May 14, 1996 entitled FOOD BEVERAGE AND ACCESSORIES PLATE offers a solution to this problem as part of the invention, incorporating a slot for napkin holding, among numerous specialized item holding features. One problem with this invention is the considerable food-holding area sacrificed to specialized features, causing the invention to be unable to function as a general-purpose plate.

Few of the inventions listed here are able to function as a conventional disposable food plate. All of these inventions have either at least one feature that would be a significant disadvantage for someone who wished to simply use a disposable food plate, or a manufacturer who wished to provide a more capable food plate without incurring additional manufacturing or assembly steps and thus additional costs. There is a need for a disposable food plate that can address all of these problems without sacrificing the low cost and general utility of the traditional design.

A significant improvement over the existing art would be a disposable food plate that cost no more to manufacture than conventional disposable food plates, had means for retaining food at least equal in capability to the conventional design, had no functional disadvantages or limitations compared to the conventional design, that provided improved plate handling and stabilizing features, and most importantly, provided a convenient, safe and sanitary way to handle and stabilize food on the plate.

SUMMARY

In accordance with the present invention, a tab plate is disclosed that permits the gripping of food without direct contact, with no loss of regular food plate function, with all features integral to the structure, no assembly required, no distortion of the plate body while using any of the special features, and no significant increase in manufacturing cost.

The basic tab plate is the shape of a regular disposable food plate with a generally flat bottom bordered by a raised rim that serves to retain food on the plate and stiffen the plate, but with the addition of an at least partially flexible tab emerging from one side of the rim. Any material or combination of materials used for the manufacture of conventional disposable food plates may be used to manufacture the tab plate.

The primary functions of this tab are be used in the flat unfolded form to help stabilize the plate when the plate is filled with food, and to be folded up and over the plate body and food contents by the user or server to function as a sanitary barrier for gripping the food. This tab is formed generally parallel to the bottom of the plate, and has a main axis generally at right angles to the edge of the plate. The tab may be bordered by a lip formed to stiffen portions of the tab, and to help provide better gripping of food on the plate. In the former case, the tab lip provides the rigidity needed to allow the unfolded tab to function as a stabilizing handle. In the latter case, the height of the tab surface and the tab lip are designed to give optimal food gripping when folded. Ideally, the overall tab structure is dimensioned to add as little area to the plate as possible, but at the same time to provide adequate area for efficient food gripping.

The folding of the tab may be assisted by formed fold lines in the tab surface, thus making the initial folding less dependent on the manual skill of the user. The primary fold line is ideally positioned both tangent to and coincident with the edge of the plate body. Other fold lines are ideally oriented parallel to and spaced outwards from the primary fold line. A series of raised features may also be formed into the underside of the plate and the tab, thus giving better grip when handling the plate full of food. A series of perforations may be formed running most of the length of the tab, allowing the user to tear open a slit in the tab and insert some combination of eating utensils, food serving utensils or a napkin as a convenience feature. It is also possible to have a tab plate with multiple tabs, to potentially give more handling convenience to the user.

Additionally, the tab plate may be formed in a novelty shape, such as a cartoon, promotional or affiliation character or emblem. In such a novelty shape, the tab or tabs may be formed as sections of the design that when articulated will represent in a useful fashion a section of the represented character or emblem, such as a limb or other appendage.

Other features, functions and aspects of the invention will become evident from the Detailed Description that follows.

BRIEF DESCRIPTION OF THE SEVERAL VIEWS OF THE DRAWINGS

The present version of the invention will be more fully understood with reference to the following Detailed Description in conjunction with the drawings of which.

DETAILED DESCRIPTION

A tab plate is provided that allows the user to better hold and balance a plate filled with food and to grasp food served on the plate without directly touching the food. The presently. disclosed tab plate includes a disposable plate with at least one articulated tab formed on the rim, able to be folded up and over the plate at selected fold lines, to aid in grasping the food contents of the plate. The full range of materials that are used to manufacture standard disposable plates may be used to manufacture a tab plate, including but not limited to paper or paperlike material, coated paper, cardboard, corrugated cardboard, corrugated plastic sheet, thermoformed plastic sheet, molded plastic, molded thermoplastic elastomer, molded foam, a composite of several of these materials, or any other thin, flexible material or combination of thin, flexible materials formed as one piece and incorporating a bendable hinge structure with one or more areas designed for bending.

Figure 1:
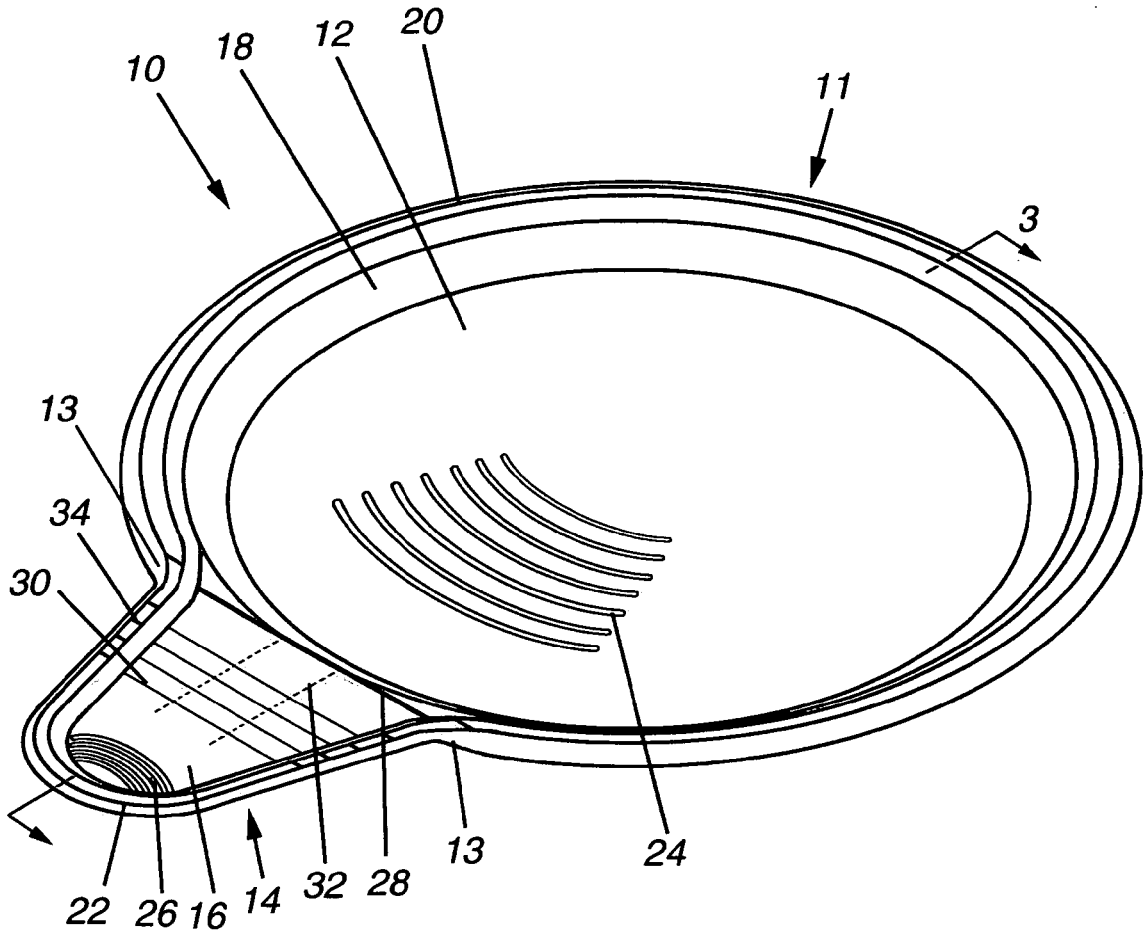
FIG. 1 is a perspective view of a tab plate.

FIG. 1 depicts an illustrative embodiment of a tab plate 10, in accordance with the present invention. The main sections are a plate 11 and a tab 14, joined by a main fold line 28 and a pair of transitional areas 13. The plate 11 is essentially a conventional disposable plate, with a center portion including a plate top surface 12 for supporting food, bordered by a perimeter 18 that acts as a retaining perimeter means for preventing spillage or sudden motion or some slight tilt from dislodging the food from the plate. The perimeter 18 for most of the circumference is bordered on the outer edge by a plate lip 20, where the plate lip 20 and perimeter 18 together are generally formed in such a way as to stiffen the structure of the plate. This means for stiffening generally results from the combination of the plate lip 20 and the perimeter 18 forming an approximately toroidal section. The plate lip 20 is generally shaped with a convex profile. These two structures together are also referred to as the plate rim. The tab 14 emerges from the section of the perimeter 18 not bounded by the plate lip 20, and extends with the tab top surface 16 generally parallel to the plate top surface 12. The tab 14 has a longitudinal axis that is generally at right angles to the edge of the perimeter from which it has emerged.

Figure 2:
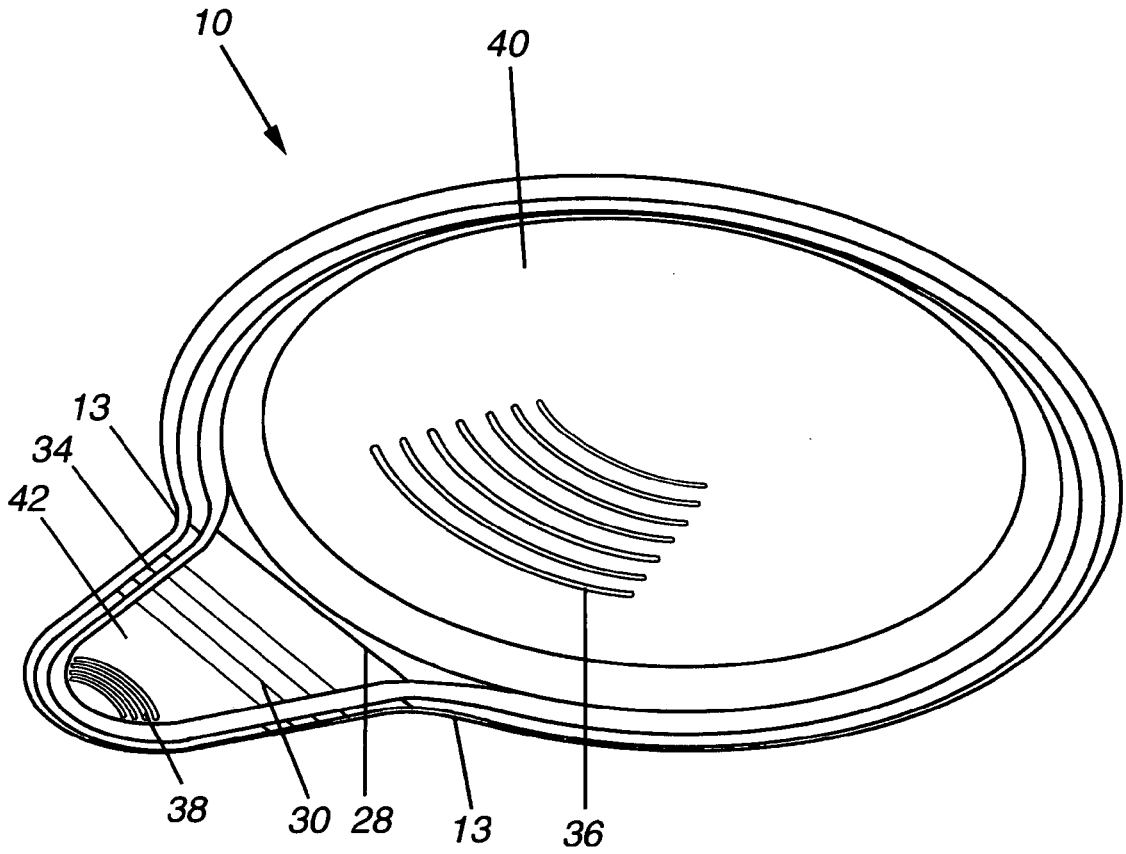
FIG. 2 is a perspective view of the underside of the tab plate of FIG. 1.

In this preferred embodiment, the height of the tab top surface 16 is approximately 75% of the total height of the tab plate, measuring from the plate bottom surface 40 shown in FIG. 2 to the top of the tab lip 22. In this preferred embodiment, the tab lip 22 serves as a means for tab stiffening. This ratio of tab top surface 16 height to tab lip 22 height produces an optimal geometry both for use of the unbent tab as a rigid stabilizing handle for the plate, and for use of the bent tab as a means to grip food on the plate. This gripping means gives a stiff raised ridge with a substantially flat area behind the ridge, allowing an initial high level of force per unit area on the food, followed by contact with the flat area limiting the amount of compression of the food. Alternatively, the tab lip 22 may have an uneven or interrupted surface, allowing even more gripping capability though potentially reducing the stiffness of the tab 14. Having the tab top surface 16 height ratio be higher or lower than the height ratio of the preferred embodiment may give other uses to the tab plate 10, and the range of useful heights for the tab top surface 16 is considered to be bounded by the plate top surface 12 and the top of the tab lip 22.

The tab 14 can have a range of dimensions and aspect ratios and still maintain useful function. The minimum useful overall length for the tab 14 is at least 2 inches, and the maximum useful overall length for the tab is about 50% of the nominal width of the plate 11, measured across the maximum width of the plate lip 20 bordering the perimeter 18. The width measurement of the tab 14 does not include the transitional areas 13, and a useful minimum tab width is about 20% of the nominal width of the plate 11, and a useful maximum tab width is about 75% of the nominal width of the plate 11. The transitional areas 13 may include substantial corner radii for the tab 14, or may be so small as to be effectively nonexistent except as arbitrary boundaries. For a round tab plate, the nominal width is the diameter of the plate 11, but for a non-round tab plate the nominal width is generally calculated as the average of the minimum plate width and the maximum plate width, not including the tab 14 in either width measurement. The maximum height of the plate lip 20 above the plate bottom surface 40 will be no more than 20% of nominal width of the plate 11.

Figure 4:
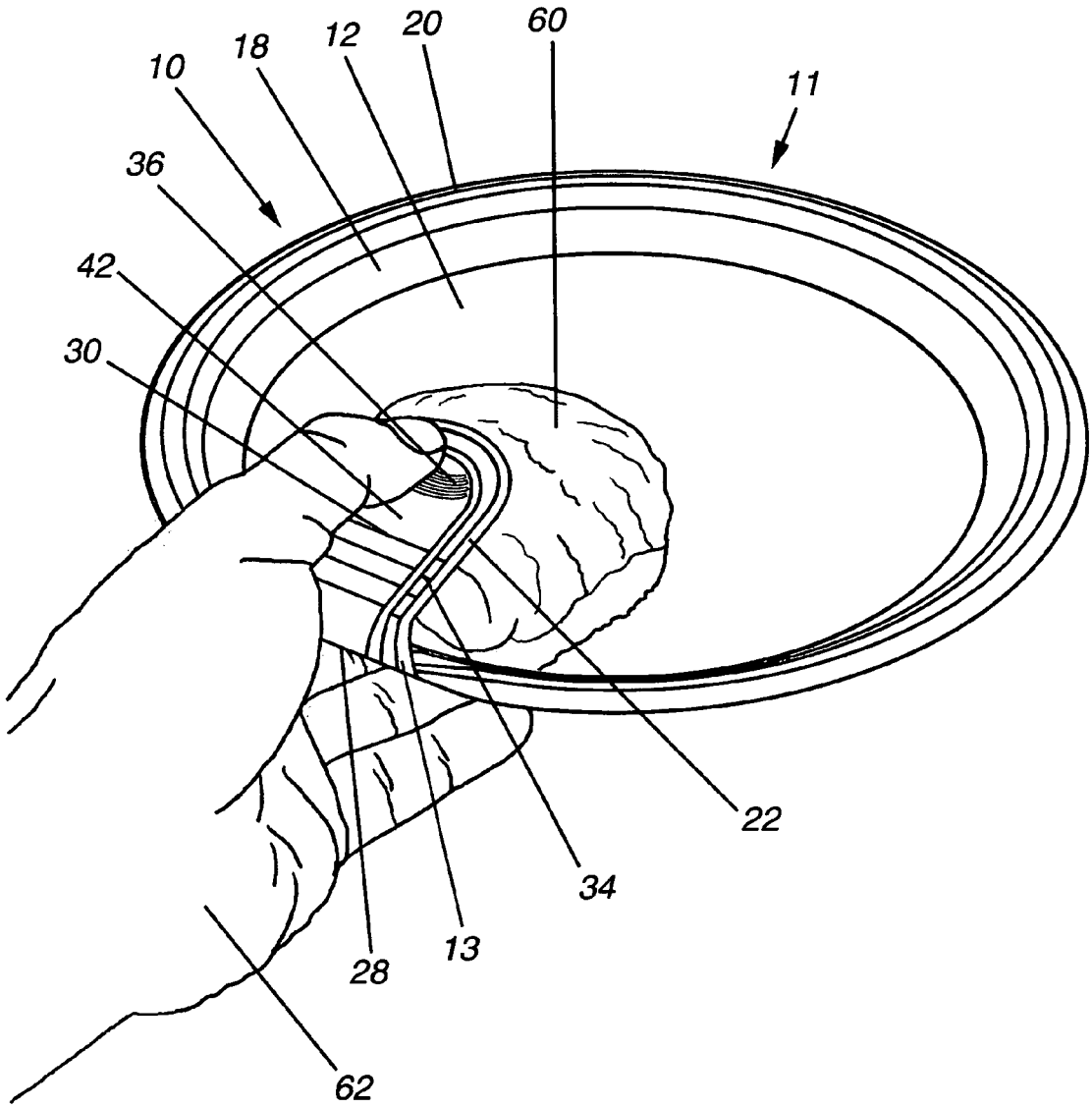
FIG. 4 is a perspective view of the tab plate of FIG. 1, with a hand using the tab to grip food.

The primary means for folding the tab 14 is a main fold line 28 that connects a portion of the perimeter 18 to the tab top surface 16, where this tab top surface 16 is additionally bordered by the two transitional areas 13 and the tab lip 22. The transitional areas 13 are generally radial in shape and also serve to connect the plate lip 20 to the tab lip 22. In the preferred embodiment, the tab 14 is used for gripping by being folded upwards at the main fold line 28 to urge the tab 14 up and over the plate top surface 12. In the preferred embodiment there are secondary fold lines 30 that may be used to further articulate the tab 14 to aid the user's hand 62 as shown in FIG. 4 in grasping the food contents 60 of the plate 11. Alternate means for articulation include having more flexible materials incorporated into the structure of the tab plate 10 in places where movement is needed, for example between the plate 11 and the tab 14.

The transitional areas 13 also serve the function of allowing the width of the plate lip 20 and the tab lip 22 to differ but maintain a smooth shape transition, which aids in the esthetic design of the tab plate 10, while permitting the plate 11 and tab 14 sections of the tab plate 10 to each have their mechanical properties adjusted for ideal performance.

Additionally in the preferred embodiment as shown in FIG. 2, there is a plate bottom surface 40 with a pattern of formed plate ridges 36, and a tab surface bottom 42 with a pattern of formed tab ridges 38. The plate ridges 36 and tab ridges 38 serve to further aid the hand of the user in grasping the tab plate 10 when loaded with food contents 60. In the general types of materials and processes from which disposable plates are made, there will be plate ridges undersides 24 evident on the plate top surface 12 and tab ridges undersides 26 evident on the tab top surface 16. In the preferred embodiment, the plate ridges 36 and tab ridges 38 are formed such that they offer improvement in hand contact and grasping of the tab plate 10, without creating such deep channels in the opposite sides as to trap food particles or to create an unsightly look.

When the tab 14 is articulated to aid in gripping the food contents 60, the presence of the tab lip 22 greatly improves the food retaining capability of the tab plate 10 over that offered by just the combination of the perimeter 18 and the plate lip 20.

Figure 3:
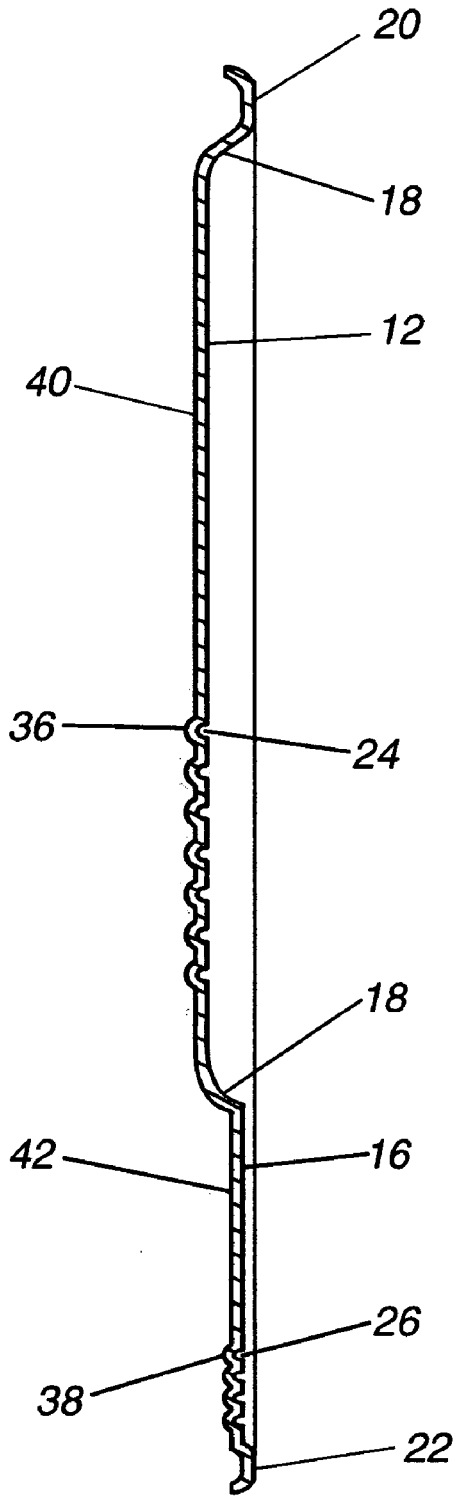
FIG. 3 is a section view of the tab plate of FIG. 1, with exaggerated thickness to clarify section details.

FIG. 3 shows a sectional view through the embodiment of the tab plate 10 depicted in FIG. 1, illustrating details of the plate lip 20 and the tab lip 22, as well as the perimeter 18, plate ridges 36 and tab ridges 38.

To further aid tab 14 articulation in the preferred embodiment, there are tab lip fold lines 34 shown in FIG. 1 and FIG. 2 associated with the main fold line 28 and secondary fold lines 30 that will aid in bending or separating sections of the tab lip 22.

Thus the tab plate 10 may be used for the handling of food without soiling the user's hands, the sanitary serving of food from a vendor to a customer, and the handling of uncomfortably hot food with increased personal safety and convenience. In the preferred embodiment, the user or server fills the plate 11 with food contents 60, and then bends the tab 14 upwards from at least the primary fold line, arching the tab 14 up and over the food contents 60. The user or server then grasps the filled plate between the thumb and fingers by placing the thumb over the tab and the fingers under the plate, and with their hand 62 so positioned as shown in FIG. 4, are then able to maneuver the filled plate 11 without directly touching the food contents 60. Alternatively, the user or server may bend the tab 14 up before loading the plate 11 with food contents 60. Other gripping styles are possible, depending on the preference and dexterity of the user or server.

Figure 5:
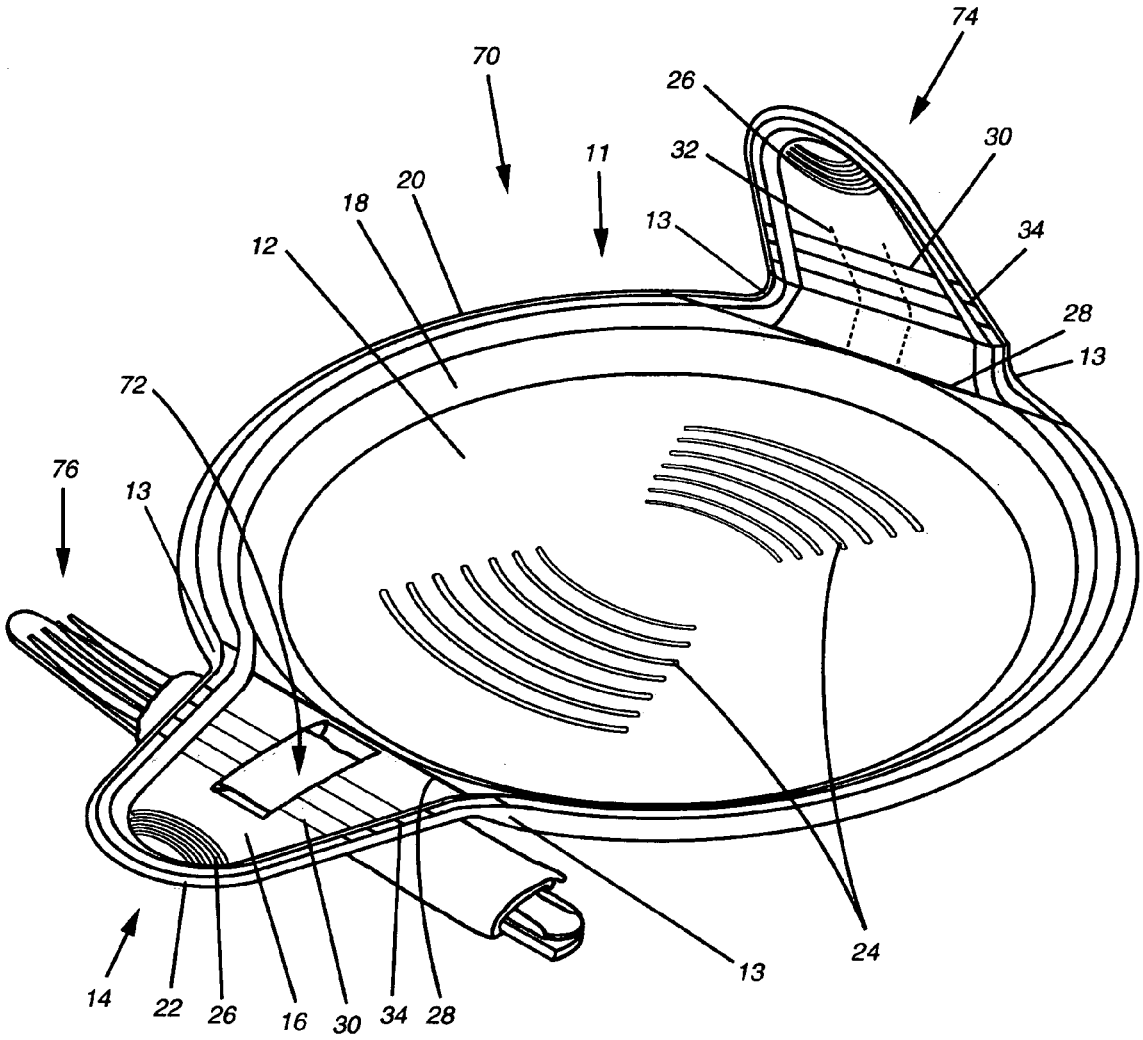
FIG. 5 is a perspective view of a tab plate with two tabs, one tab shown folded into the gripping position and one tab shown slotted and with utensils inserted.

Further in the illustrated embodiment, there are perforations 32 in the tab top surface 16 that may be separated or torn to produce a utensil slot 72 as shown in FIG. 5, allowing some combination of eating utensils 76, food serving utensils, napkins or other food related tools and accessories to be held in the structure of the tab plate 10. The perforations 32 represent only one of several means for controlled tearing that may be used to open up this utensil slot 72, where this means for controlled tearing may alternatively be a pattern of embossed thin areas, molded-thin areas, mostly-cut areas, formed slits or any other result of a manufacturing method that yields a selectively thinned or weakened area to enable controlled tearing.

Additionally, the user may have the tab 14 serve as a wall to capture food against with a utensil such as a fork or a spoon, by bending the tab 14 up to a position approximately orthogonal to the plate top surface 12. The tab 14 may also be left in the un-bent position and gripped as a means for stabilizing the plate 11 when the plate 11 is loaded with food contents 60.

While the tab plate 10 has been shown to offer several significant functional improvements in food handling over the conventional disposable plate, at the same time the tab plate 10 does not have any less utility than the conventional disposable plate. In addition, the tab plate 10 can be produced by the same manufacturing operations as the conventional disposable plate, and as such should incur no significant additional cost in manufacturing.

Having described the above illustrative embodiment, other alternative embodiments or variations may be made. For example, FIG. 5 depicts a two tab plate 70 with a second tab 74 for further aid in grasping food contents 60 without direct contact. The utensil slot 72 may be formed in a single tab, or in multiple tabs.

Figure 6:
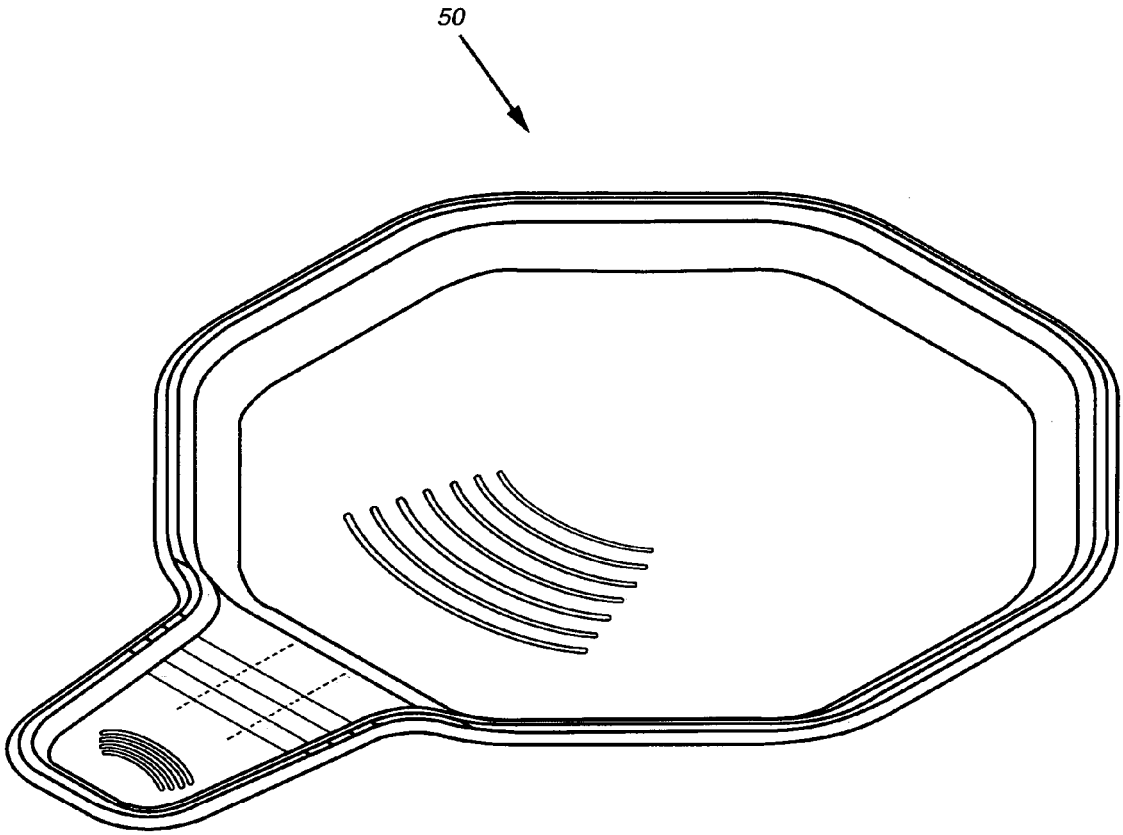
FIG. 6 is a perspective view of an octagonal tab plate.

In another alternate embodiment, FIG. 6 depicts an octagonal plate 50 that demonstrates that the tab plate concept is applicable to food plates of varied shapes. The tab itself may be made more useful for specific applications by shaping it for example to taper outwards rather than inwards as illustrated here, or simply with parallel sides.

In addition to any of the standard disposable plate shapes or any other generally planar practical shape that can hold food, the tab plate may be formed in a novelty design shape such as an animal, or any cartoon, promotional or other media character or persona, or a national, religious or other affiliation symbol, character or emblem, where the tab is designed to function as a portion of the novelty shape, and thus using the tab to grip the food further allows the novelty shape to be functional as well as entertaining.

In a further alternate embodiment, the tab plate may be formed of multiple materials, with the plate material and the tab material being more rigid, and a more flexible articulating material used to join the plate and the tab.

In yet a further alternate embodiment, the tab plate may be formed of thermally insulating materials, allowing the user to grasp heated foods that might be uncomfortable or even dangerously hot without this protection. The thermally insulating materials may be used for the entire tab plate structure, or may be used in portions of the plate and the tab, with a more flexible articulating material in the region joining the plate and tab.

Other methods of use are possible for the tab plate. The un-bent tab may serve as a place to put a drinking cup or heavy utensils to weigh down an empty tab plate 10 and prevent a gust of wind from blowing it away. Further, the tab 14 may be folded along the perforations 32 and be used as a pouring spout for guiding unused contents back into a container. The tab 14 may also be simply flattened, bent down, and folded under the body of the plate 11 to get it out of the way, if the user is trying to locate the tab plate 14 on a crowded surface.

Having described herein illustrative embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A tab plate comprising:

a substantially planar center portion adapted for use with food and having a plate top surface and a plate bottom surface;

said plate top surface bounded by a retaining perimeter means;

said perimeter means including an outer edge and means for stiffening the combination of said perimeter means and said center portion;

at least one tab extending outwards from said perimeter means and having a tab top surface and a tab bottom surface;

said tab top surface oriented substantially parallel to said plate top surface and having a longitudinal axis oriented substantially orthogonal to the outer edge of said perimeter means;

said tab providing means for stabilizing when said tab plate is filled with food; and said tab further being formed as one piece with said tab plate and incorporating a bendable hinge structure with one or more areas designed for bending whereby said tab may be folded upwards and over said center portion to provide gripping means when urged towards said food and said center portion.

2. The tab plate of claim 1, wherein at least a portion of said outer edge of said perimeter means is a convexly shaped plate lip.

3. The tab plate of claim 1, wherein said tab includes means for tab stiffening at least a portion of the surface area of said tab.

4. The tab of claim 3, wherein said means for tab stiffening at least a portion of the surface area of said tab includes a convexly shaped tab lip bounding said tab top surface.

5. The tab of claim 4, wherein the combination of said tab top surface and said tab lip provides additional gripping means.

6. The tab of claim 4, wherein said tab lip includes tab lip fold lines to function as at least a portion of said bendable hinge structure.

7. The tab of claim 5, wherein the height of said tab top surface is between the height of said plate top surface and the maximum height of said tab lip.

8. The tab of claim 7, wherein said tab top surface is at a height approximately 75% of the overall height of said tab plate; and said tab lip forms a continuous border for said tab plate in combination with a pair of transitional areas and said plate lip.

9. The tab plate of claim 1, wherein:

said tab is proportioned with an overall length between a minimum of 2" and a maximum of 50% of the nominal width of said plate; and said tab is proportioned with an overall width neglecting corner radii ranging between 20% and 75% of the nominal width of said plate.

10. The tab plate of claim 1, wherein said perimeter means has a height no greater than 20% of the nominal width of said plate.

11. The tab plate of claim 1, wherein said plate is manufactured from at least one of the materials from the group consisting of paper, moisture-resistant coated paper, cardboard, corrugated cardboard, foamed plastic, thermoformed plastic sheet, corrugated plastic sheet, molded plastic, molded foam, molded thermoplastic elastomer and combinations of thin, flexible materials thereof.

12. The tab plate of claim 1, wherein said bendable hinge structure includes at least one means for folding formed in said tab, said means for folding being oriented substantially orthogonal to the longitudinal axis of the tab.

13. The tab plate of claim 11, wherein one means for folding is additionally positioned substantially tangent to said outer edge of said perimeter means.

14. The tab plate of claim 1, wherein said bendable hinge structure includes at least one articulating material more flexible than the plate material and the tab material, said articulating material being connected between said plate material and said tab material.

15. The tab plate of claim 1, wherein said center portion is round in shape.

16. The tab plate of claim 1, wherein said center portion is a shape other than round.

17. The tab plate of claim 16, formed with a novelty design shape and using at least one tab as a portion of the novelty design shape.

18. The tab plate of claim 1, wherein the tab has at least one feature from the group consisting of formed slits, tearable perforations and means for controlled tearing, said feature being oriented substantially parallel to the longitudinal axis of said tab, said feature dimensioned such that when pulled open, at least one piece of tableware from the group consisting of eating utensils, food serving utensils, napkins and other food related tools and accessories may be inserted and retained in said feature.

19. The tab plate of claim 1, wherein said plate bottom surface has a raised pattern and said tab bottom surface has a raised pattern, said raised patterns functioning cooperatively as means for assisting in manually gripping said tab plate when said tab is gripping said food.

20. The tab plate of claim 1, wherein at least one portion of the tab plate is made of thermally insulating material.

21. A tab plate comprising:

a substantially planar plate center portion adapted for use with food and having a plate bottom surface and a plate top surface, said plate center portion being round in shape, said plate bottom surface being at least partly covered by a raised pattern providing improved grasping, said plate top surface bounded by a retaining perimeter means, said perimeter means extending upwardly and outwardly and having an outer edge, said outer edge bounded by a convexly shaped plate lip for at least half of the outer edge circumference, whereby the combination of said perimeter means and said plate lip provide means for stiffening said plate;

a tab comprising a substantially planar tab center portion bounded by a tab lip, said tab center portion oriented substantially parallel to said plate center portion and at a height approximately 75% of the overall height of said tab plate and having a tab bottom surface and a tab top surface, said tab bottom surface being at least partly covered by a raised pattern providing improved grasping, said tab lip being convexly shaped and extending from said tab top surface and forming a continuous border for said plate in combination with a pair of transitional areas and said plate lip;

said tab extending outwards from said perimeter means along the section of said outer edge circumference not bounded by said convexly shaped plate lip and having a longitudinal axis radially oriented with respect to said plate center portion;

said tab having a primary means for folding formed tangent to said outer edge of said perimeter means;

said tab further having at least one secondary means for folding formed parallel to and spaced outwardly from said main means for folding;

said tab lip including tab lip fold lines to function as at least a portion of said means for folding;

said tab further having at least one slit feature from the group consisting of formed slits, tearable perforations or means for controlled tearing, said slit feature being oriented substantially parallel to the longitudinal axis of said tab and dimensioned such that when pulled open, at least one piece of tableware from the group consisting of eating utensils, food serving utensils and napkins may be inserted and retained in said feature;

said tab further having a width less than the diameter of said plate center portion; said tab further having a length less than the diameter of said plate center portion; and said tab plate is manufactured from at least one of the materials from the group consisting of paper, moisture-resistant coated paper, cardboard, corrugated cardboard, foamed plastic, thermoformed plastic sheet, corrugated plastic sheet, molded plastic, molded foam, molded thermoplastic elastomer and combinations of thin, flexible materials thereof.

22. The tab plate of claim 21, wherein said center portion is a shape other than round.

* * * * *